United States Patent [19]

Englert et al.

[11] 4,228,630

[45] Oct. 21, 1980

[54] WINDOW FRAME CONSTRUCTION

[75] Inventors: Herbert U. Englert, Deal; Jack Demray, Atlantic Highlands, both of N.J.

[73] Assignee: Englert Metals Corp., Perth Amboy, N.J.

[21] Appl. No.: 883,526

[22] Filed: Mar. 6, 1978

Related U.S. Application Data

[63] Continuation of Ser. No. 704,179, Jul. 12, 1976, abandoned.

[51] Int. Cl.[2] ..... E04C 2/38; E06B 3/00

[52] U.S. Cl. ..... 52/656; 52/204; 52/211; 52/288

[58] Field of Search ..... 52/656, 288, 475, 712, 52/657, 211, 213; 403/231, 401, 402, 403; 85/11, 13; 248/300; 40/155; 46/31

[56] References Cited

U.S. PATENT DOCUMENTS

| | | | |
|---|---|---|---|
| 144,599 | 11/1873 | Burch | 403/231 |
| 418,756 | 1/1890 | Schwartz | 52/657 |
| 838,816 | 12/1906 | Sherwood | 40/155 |
| 1,561,470 | 11/1925 | Kihm | 52/657 |
| 1,823,485 | 9/1931 | Bremer | 40/155 |
| 2,291,726 | 8/1942 | Kaufmann | 52/211 X |
| 2,379,179 | 6/1945 | Peterson | 85/13 |
| 2,633,653 | 4/1953 | Angus et al. | 40/155 X |
| 2,741,347 | 4/1956 | Angelotte | 52/213 |
| 2,843,232 | 7/1958 | Goldberg | 52/211 |
| 2,916,781 | 12/1959 | Kelly | 403/401 X |
| 3,139,703 | 7/1964 | Hilt | 52/211 X |
| 3,269,068 | 8/1966 | King | 403/401 X |
| 3,451,153 | 6/1969 | Dohanyos | 40/155 |
| 3,469,360 | 9/1969 | Peterson et al. | 403/401 X |
| 3,729,870 | 5/1973 | Kvalheim et al. | 52/211 X |
| 3,789,527 | 2/1974 | Mohr | 403/402 X |
| 3,921,253 | 11/1975 | Nelson | 248/300 |

FOREIGN PATENT DOCUMENTS

| | | | |
|---|---|---|---|
| 271589 | 2/1930 | Italy | 40/155 |
| 175797 | 3/1922 | United Kingdom | 403/402 |

*Primary Examiner*—Leslie Braun

*Attorney, Agent, or Firm*—Sommers & Sommers

[57] ABSTRACT

This invention relates to a window frame construction. In practice, on installation of window frames comprising top and side members, the junctures or top corners thereof are frequently open slightly or out of registry forming a weak structure of non-workmanlike appearance. Pursuant to the invention, a window frame construction is provided including an elongated or top window frame bar and side window frame bars assembled with their ends in abutting juncture.

1 Claim, 5 Drawing Figures

WINDOW FRAME CONSTRUCTION

This application is a continuation of application filed July 12, 1976, Ser. No. 704,179 now abandoned.

SUMMARY OF THE INVENTION

The invention is designed to overcome disadvantages of prior structures by providing an easily-applied combination window frame construction including an elongated channelled horizontal or top window frame bar and channelled side window frame bars corner assembled with their ends in abutment, defining an inverted U-shape, and closure plates covering abutting corners of the window frame and frictionally engaging connecting and holding them in registry, said closure members being of such structural features as will enable them to be readily prefabricated and furnished to builders and contractors for simple installation, in situ, without use of any tools. The closure unit, thus applied, becomes an essentially unitary interlocking part of the window frame, effectively closing the corners and enhancing the appearance of the frame and holding the window frame bars closed position against accidental displacement thereof. The closure units interlock and interfit in registry with the corner members of the channelled window frame; said closure units each comprise an outer frame cover portion and having grooves therein forming depending inner gripping surfaces.

DESCRIPTION OF THE DRAWINGS

This invention is exemplarily illustrated in the accompanying drawings wherein.

DESCRIPTION OF PREFERRED EMBODIMENT

Figure 1:
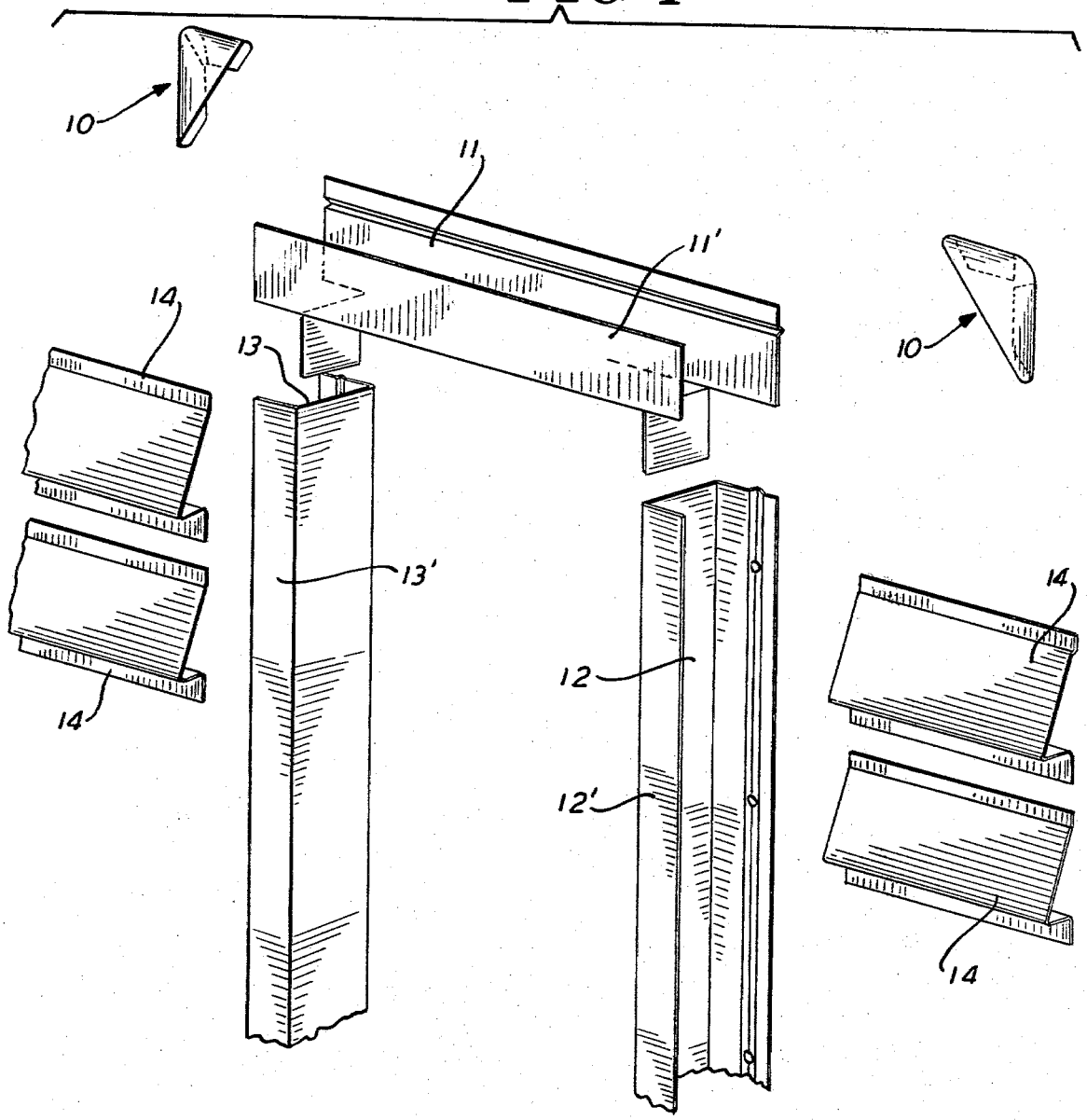
FIG. 1 is an exploded view showing horizontal and vertical channelled side members of a window frame and associated siding members and corners of the horizontal and vertical channelled side members, defining therewith the interlocked registered window frame.

As shown exemplarily in FIG. 1, the horizontal and vertical side window frame members 11,12 and 13, together with the sill of the window comprise the rectangular window frame; associated siding members 14 are shown in typical installation in conjunction with which the window frame including members 11,12,13 may be used. Each of the latter comprises essentially a U-shaped channel including bar portions 11',12',13' in connection with which the closures of the invention may be used. Frame members 11,12,13 may be secured to the building structure as by suitable fastener means 15, (FIG. 2).

Figure 2:
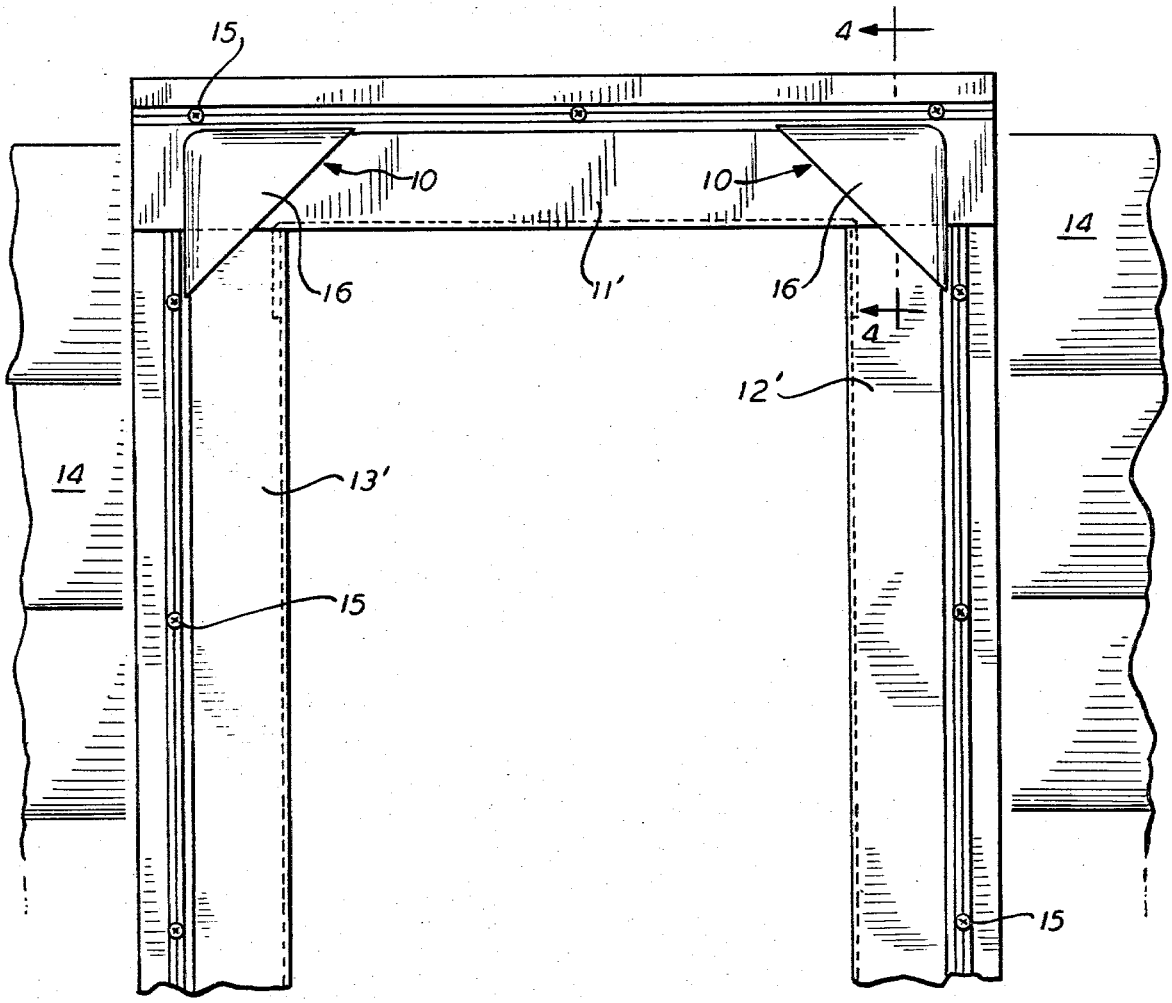
FIG. 2 is a horizontal, elevational, view of the window frame parts assembled, with the closure units of the invention positioned at the upper corners of the frame.
Figure 3:
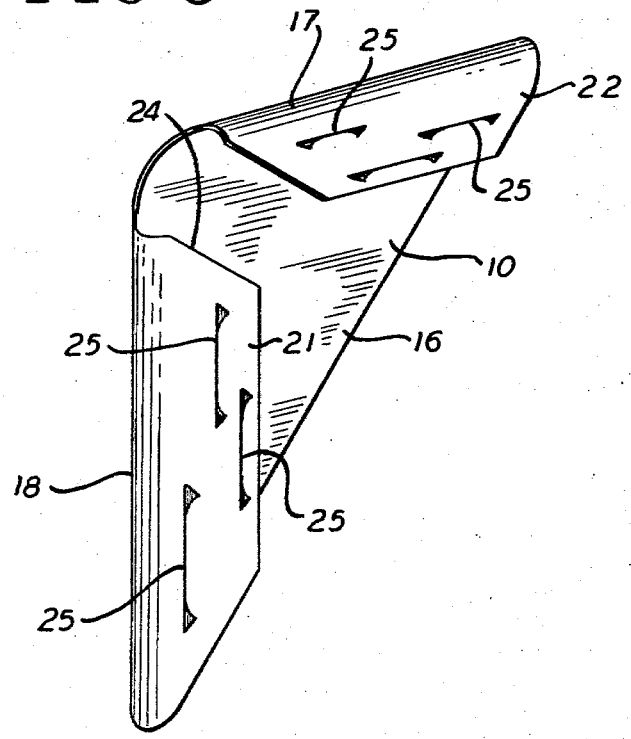
FIG. 3 is an enlarged, rear, perspective view of a closure unit of the invention.
Figure 4:
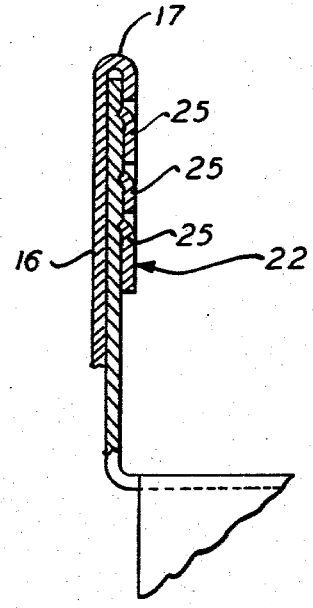
FIG. 4 is a fragmentary vertical sectional view thereof, taken at line 4—4 of FIG. 2.
Figure 5:
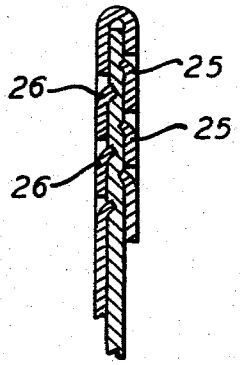
FIG. 5 is a similar fragmentary, vertical sectional view of a further form thereof.

As illustrated in FIG. 2, for example, pursuant to the invention the top and side window frame bars, 11',12',13' are assembled with their ends in abutment, defining an inverted U-shape; the closure device 10 of the invention may be made from a blamk or stock of metal or other material and bent to define spaced gripping sections and an essentially Y-shaped slot 24 (FIG. 3) to receive and grip the top and side window frame bars 11',12',13' therein in essentially right-angular corner relation and closing and reinforcing said corners of the window frame. The closure device 10 comprises a plate having a side wall portion 16 telescopically registering with abutting ends of bars 11',12',13' (FIG. 2) said plate being bent angularly from said side wall portion to define flanged portions 17,18 and being further bent beyond said flanged portions to define further gripping panels 21,22 spaced apart to receive the abutting edges of the window frame bars, and preferably elongated indentations 25 formed on said gripping panels, spaced from the flanges and frictionally engaging the bars, securing them together and defining covered and reinforced corners of the combination window frame construction therewith. Closure device 10 may be formed of metal or other material to thus define a triangular panel portion 16 with spaced, angularly bent, side flanges 17,18 terminating in and connecting inwardly directed triangular gripping portions 21,22 spaced from and parallel to the panel portion 16 and telescopically receiving and gripping adjacent ends of the bars 11',12' and 13' of frame members 11,12,13, as shown in FIG. 4. The right angularly disposed elongated gripping 21 and 22 extend inwardly of flanges 17,18 and are spaced apart to define a "Y" shaped slot opening 24 (FIG. 3) to receive the abutting edges of the window frame bars. The unit 10 is preferably provided with inwardly directly depressed portions or slots 25 preferably parallel to flanges 17,18, and formed in spaced parallel relation thereto on each portion 21,22 (FIG. 3) to enhance the closure gripping action, interlocking the frame bars and reinforcing them at the window frame corners, the elongated indentations or one gripping portion hereof disposed at right angles to those on the other gripping portion. Inwardly directed gripping portions 26 may be formed on the panel 16 as (FIG. 5) additionally to or in lieu of gripping portions 25 on the portions 21,22.

While the invention has been set forth above in terms of a specific embodiment thereof, variations therein may be made be those skilled in the art which are nevertheless within the scope and spirit of the invention. The invention, therefore, is to be broadly construed within the scope and spirit of the claims appended hereto.

I claim:

1. A window frame, comprising:

(a) a top bar having opposite ends, (b) a pair of side bars abutting the top bar ends, forming, therewith, two top window frame corners of an inverted U-shaped window frame configuration, (c) a pair of plates, (d) each plate including a triangular side wall portion telescopically registrable with and covering the abutting ends of the top and side bars, (e) each plate further including a pair of flanged portions bent angularly from two adjacent edges of the side wall portion and each disposed at right angles thereto, (f) each plate further including a pair of spaced trapezoidal gripping portions, bent angularly beyond the flanged portion and parallel to the side wall portion and defining therewith a Y-shaped slot receiving said abutting corner of the top bar and side bar, (g) each plate further including a plurality of parallel spaced elongated indentations formed in each of said gripping portions, parallel with flanged portion of the plate from which such gripping portion depends, and spaced therefrom and frictionally engageable with and covering said abutting portions of the top and side bar, (h) said indentations reinforcing said top and side bars.

* * * * *